US005671481A

United States Patent [19]

Giard

[11] Patent Number: 5,671,481

[45] Date of Patent: Sep. 30, 1997

[54] FOLDING SWEATBAND WITH INTERIOR COMPARTMENT

[76] Inventor: B. Joan Giard, 19 Discovery Rd., Essex Junction, Vt. 05452

[21] Appl. No.: 680,322

[22] Filed: Jul. 12, 1996

[51] Int. Cl.[6] ..... A45C 13/30; A41D 20/00

[52] U.S. Cl. ..... 2/170; 224/222

[58] Field of Search ..... 2/170, 171, 162, 2/DIG. 11, 181, 171.2, 181.4, 160; 224/219, 222, 267; 150/100, 131, 132; 15/209.1

[56] References Cited

U.S. PATENT DOCUMENTS

| | | | |
|---|---|---|---|
| 2,400,222 | 5/1946 | Cline | 150/132 X |
| 2,459,992 | 1/1949 | Cimino | 224/222 |
| 2,711,202 | 6/1955 | Freedman | 224/222 X |
| 2,881,441 | 4/1959 | Bass | 224/222 X |
| 3,670,933 | 6/1972 | Jones | 224/222 |
| 4,047,400 | 9/1977 | Thorneburg | 66/171 |
| 4,224,712 | 9/1980 | Black et al. | 15/209 R |
| 4,403,366 | 9/1983 | Lucke | 15/209 R |
| 4,462,116 | 7/1984 | Sanzone et al. | 2/170 |
| 4,763,821 | 8/1988 | Powell | 224/267 |
| 4,771,502 | 9/1988 | Trimble | 15/209 R |
| 4,805,242 | 2/1989 | Bolton | 2/160 |
| 4,843,653 | 7/1989 | Coble | 2/170 |
| 4,905,881 | 3/1990 | Graber | 224/267 X |
| 5,012,543 | 5/1991 | Lewis, Sr. | 15/209 R |
| 5,029,343 | 7/1991 | McIntyre | 2/115 |
| 5,147,703 | 9/1992 | Provost et al. | 428/82 |
| 5,305,470 | 4/1994 | McKay | 2/170 X |
| 5,341,972 | 8/1994 | Jacks | 224/219 X |
| 5,588,571 | 12/1996 | Mazzo | 224/267 X |

FOREIGN PATENT DOCUMENTS

| | | | |
|---|---|---|---|
| 434820 | 9/1935 | United Kingdom | 224/219 |

*Primary Examiner*—C. D. Crowder
*Assistant Examiner*—Shirra Jenkins
*Attorney, Agent, or Firm*—Theodore R. Touw

[57] ABSTRACT

A sweatband is made at least partially of towel fabric, and may be composed of two, three, or more plies (20, 90, 170) of fabric. Fabric material is cut, sewed, and folded to a shape adapted to provide an interior portion for carrying small articles and/or for cleaning or drying other articles. The interior portion of some embodiments has a laterally-opening pocket (100) which is folded longitudinally along a fold line (40) when in use. Other embodiments have an elastic strip (160) which folds transversely inside a fold connecting two side portions. The elastic strip (160) provides an expandable opening for inserting fingers. The elastic strip may be attached to the interior portion of the sweatband at one or more intermediate places along the length of the elastic strip, to define separate loops (225) for two or more individual fingers.

Fasteners (140, 150), such as hook-and-loop fastener strips at the two ends, provide for connecting the ends to make a closed loop to fit a wrist. The fasteners are adapted to allow accommodation to various wrist sizes. Other types of fasteners such as buttons with buttonholes, zippers, and the like may also be used. The particular shape of some embodiments is also adapted to allow free motion of a joint of the user's limb: slanted or curvilinear shapes at the two ends (50, 60) cooperate to form a notch (130) when the two ends are fastened together. In use, the notch (1:50) may be positioned to be adjacent to a joint of the user's limb, or adjacent to the user's forearm or calf.

18 Claims, 4 Drawing Sheets

FOLDING SWEATBAND WITH INTERIOR COMPARTMENT

The invention of this application is described in Disclosure Document No. 383028, received by the U.S. Patent and Trademark Office on Oct. 2, 1995.

FIELD OF THE INVENTION

This invention relates generally to accessory equipment for sports, and more particularly to sweatbands adapted to be worn by a user and used as a multipurpose wiper.

BACKGROUND OF THE INVENTION

Individuals engaging in work or in sports and exercise often need a small absorbent towel for perspiration or for wiping articles, and also need a convenient place to store small items such as a key, money, and identification.

DESCRIPTION OF THE RELATED ART

U.S. Pat. No. 4,047,400 to Thomeburg disclosed a moisture absorbent band, knit completely formed on a circular knitting machine with at least some moisture absorbent yarn. It has inner and outer integrally knit plies, usually provided with terry loops extending outwardly from each ply. The inner ply includes two sections with adjacent edges joined together with an integrally knit narrow connector tab including twice as many wales as the inner and outer plies. U.S. Pat. No. 4,224,712 to Black et al. disclosed a towel adapted to be worn by the user and a method of making the towel. A sheet of flexible material is cut to form a main body member including opposite end portions and opposite side edges extending generally transversely to the end portions. A tab member is also formed, extending out from one of the end portions. The sheet material of the main body member is folded upon itself to form an uninterrupted forward face and to position each of the side edges adjacent to and rearward of the lateral extremities of the forward face. The material is secured upon itself adjacent to the end from which the tab depends. U.S. Pat. No. 4,403,366 to Lucke disclosed a towel and method for mounting it on the belt, pants, or accessories worn by the user. A support member is made of solid material such as plastic or metal in the form of a clip and has a gripping means including a strip of fabric with hooking elements (e.g. Velcro™). A length of toweling forms an integral pocket and has receiving means including a strip of fabric with loop elements (e.g. Velcro™). The integral pocket is formed by making a double fold and stitching the side edges to form a hem and capture the double folds.

U.S. Pat. No. 4,462,116 to Sanzone et al. disclosed an athletic sweatband consisting of a continuous band of material having an interior compartment communicable with the exterior through an opening in the band, and an article container disposed in the band compartment having an opening communicable with the band opening. U.S. Pat. No. 4,771,502 to Trimble disclosed a towel adapted to be worn, and a method of making it. A single sheet of absorbent fabric is cut and folded at the top end, over a stiffening member placed against the fabric. The side edges are folded over to the rear face. The stiffening member is encapsulated in the fabric towel material by securing the various towel faces together underneath the stiffening member and securing together the various tops of the folded towel material. U.S. Pat. No. 4,843,653 to Coble showed a knitted tubular moisture-absorbent wrist band having plain knit, relatively narrow welts that fit snugly around the wrist and lower arm and that hold a center, relatively wide terry knit portion.

U.S. Pat. No. 5,012,543 to Lewis, Sr. disclosed an athletic towel formed from an elongated rectangular piece of terry cloth fabric, with an elongated strap secured across the central portion of the fabric piece. Free ends of the strap have cooperating hook and loop fasteners (such as Velcro™) for securing around the user's waist. A pocket on the fabric piece also includes cooperating hook and loop fasteners for securing the pocket in a closed position. U.S. Pat. No. 5,029,343 to Mcintyre showed an athletic shirt having a towel-like appendage attached at the neck opening on the back of the shirt. The towel may be releasably attached by hook and loop fasteners, to be used while separated from the shirt. U.S. Pat. No. 5,147,703 to Provost et at. showed a golf towel set for attachment to a golf bag or other article. The towel set has a main towel and an accessory towel releasably attached to the main towel. The main towel can have an upper strap with a Velcro™ fastener to allow closing the strap into a loop for attachment to a golf bag or cart.

PURPOSES, OBJECTS, AND ADVANTAGES OF THE INVENTION

One object of the invention is a sports accessory that combines the functions of a sweatband, a towel, and a wallet or purse. A similar object is a sweatband that includes a compartment for carrying small items, but is also useful for wiping perspiration. A related object is a sweatband with a well-cushioned compartment for carrying and protecting items while preventing their loss. Another object is an adjustable sweatband adaptable to fit various users. Another object is a sweatband which, when removed from the body, is readily adaptable for wiping sports equipment. A particular object is a sweatband which is specially adapted to facilitate free bending of a joint of the user's limb. These and other objects and advantages will be apparent from a reading of the remainder of the description in this specification and the claims, along with the accompanying figures.

SUMMARY OF THE INVENTION

A sweatband is made at least partially of towel fabric. The sweatband may be composed of two, three, or more plies of fabric. Fabric material is cut, sewed, and folded to a shape adapted to provide an interior portion for carrying small articles and/or for cleaning or drying other articles. The interior portion of some embodiments has a laterally-opening pocket which is folded longitudinally when in use. Other embodiments have an elastic strip which folds transversely inside a fold connecting two side portions. The elastic strip provides an expandable opening for inserting a finger or two fingers. The elastic strip may be attached to the interior portion of the sweatband at one or more intermediate places along the length of the elastic strip, to define separate loops for two or more individual fingers.

Fasteners, such as hook-and-loop fastener strips at the two ends, provide for connecting the ends to make a closed loop to fit a wrist. The hook-and-loop fastener strips are adapted to allow accommodation to various wrist sizes. The hook-and-loop fastener strips are attached to opposite sides of the sweatband. Other types of fasteners such as buttons with buttonholes, zippers, and the like may also be used. The particular shape of some embodiments is also adapted to allow free motion of a joint of the user's limb. Slanted or curvilinear shapes at the two ends cooperate to form a notch when the two ends are fastened together. In use the notch may be positioned to be adjacent to a joint of the user's limb, or adjacent to the user's forearm or calf.

When used wrapped around a wrist, ankle or forehead, the invention can be used as a sweatband for sports, e.g. tennis.

When off the body and opened, it can be used as a towel for wiping away perspiration on the neck, etc. using the outside towel surface. The inside surface can be used to wipe off sporting equipment such as golf balls, the head or handle grip of a golf club, the handle grip of a tennis racket, etc.

DETAILED DESCRIPTION OF THE PREFERRED EMBODIMENTS

Figure 1:
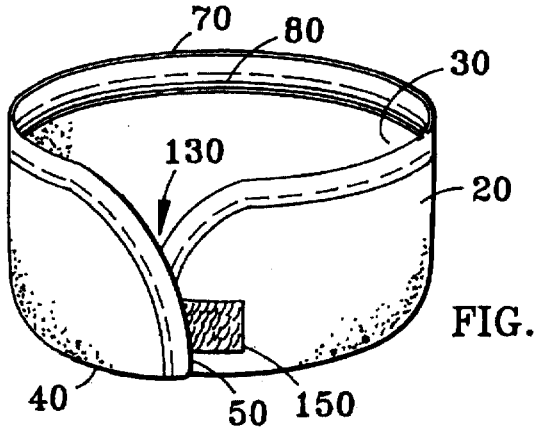
FIG. 1 shows a perspective view of a sweatband made in accordance with the invention, in its fastened position.
Figure 2:
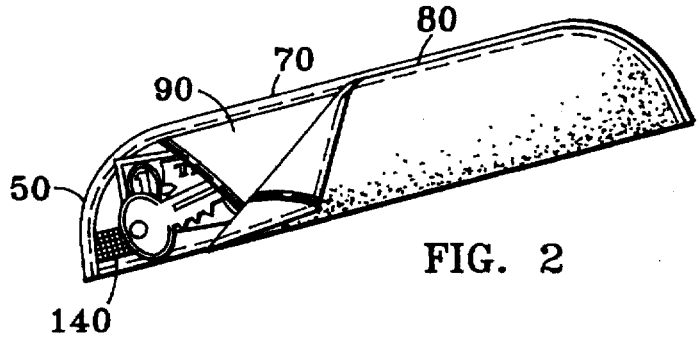
FIG. 2 shows a perspective view of the sweatband in its unfastened position.

How to make and use the invention may be understood from a reading of the following description and the accompanying drawings, in which corresponding or similar elements are designated by the same reference numerals. A first embodiment is shown in drawing FIGS. 1–7.

In one embodiment of the invention, its construction starts with an elongated first panel of fabric 20 that is moisture-absorbent on at least one side 30 and about twice as wide as the finished sweatband. The finished sweatband will be folded along a longitudinal fold line 40. The ends 50 and 60 of this first panel are preferably shaped so that the folded panel has ends that are either cut along a diagonal direction or, more preferably, curved. A second panel of fabric 90 is fastened to the first panel along at least one end and along at least a portion of the lateral edges 70 and 80 of the first panel to form a pocket 100. One method of fastening the panels is sewing, but various other methods such as serging, gluing, heat-sealing, "stitchless sewing," or sonic sewing may be used as appropriate to the particular materials used. Fastening material used (for example) in sewing or serging, may include thread or the like made of cotton, nylon, rayon, or silk, etc., or even yarn or ribbon for some decorative embodiments. The second panel may be made shorter than the first panel. The second panel will also be folded along a longitudinal medial fold line 120 corresponding to the fold line 40 of the first panel. The end of the second panel that is fastened to the first panel preferably has the same diagonal-cut or curvilinear shape as the corresponding end of the first panel. The pocket 100 is preferably made to open toward an end of the panels, rather than toward their lateral edges. When such a pocket is used for carrying small items such as a key, this pocket orientation helps prevent loss of the items from the sweatband. When the sweatband is made with a pocket oriented in this preferred orientation, fingers may be inserted longitudinally into the pocket while using the sweatband for wiping. In other embodiments, described below, a user's fingers may be inserted into loops provided by one or more elastic straps fastened to the interior portion of the sweatband.

Fasteners 140 and 150, preferably hook-and-loop fasteners such as Velcro™, are attached near the ends of the sweatband, on suitable sides of the assembled panels. For example, fastener 140 may be attached to an inside surface of exterior fabric panel 20, and fastener 150 attached to an outside surface of exterior panel 20. When the sweatband ends are brought together to form a closed loop, they are fastened together to fit the wearer's wrist or ankle, for example. The closed loop thus formed has an interior surface that includes the pocket described above. With the preferred shape of the ends of the panels, the closed loop has a V-shaped notch 130 on one edge where the ends meet. That notch allows more unrestricted movement of the user's wrist or ankle. An optional third layer of fabric, about the same size as the second panel, may be fastened inside the pocket, e.g. by sewing to the first panel to form a liner inside the pocket. That third layer may be substantially non-moisture-absorbent. The optional third layer is not shown in the drawings. It will be apparent that further layers of fabric, edge bindings, appliqués, ribbons, and the like may be added for decorative or aesthetic effect without interfering with the functional aspects of the invention.

Figure 12:
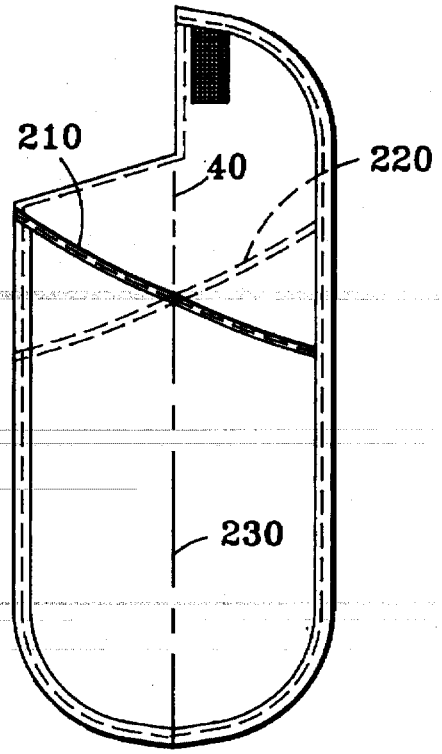
FIG. 12 shows a plan view of a sweatband with alternative pocket configurations in an unfolded, unfastened position.
Figure 14:
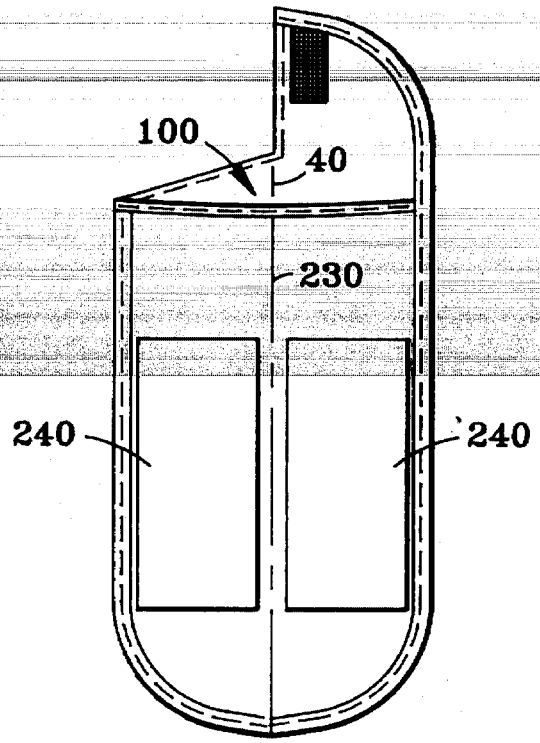
FIG. 14 shows a plan view of another sweatband embodiment, in an unfolded, unfastened position.

FIGS. 1–7 show various views of a preferred embodiment of the invention. The sweatband has an exterior panel of fabric 20 having at least one side composed of moisture-absorbent fabric 30 such as terry-cloth toweling. Exterior panel 20 will be folded in use along a fold line 40 extending longitudinally between its two ends 50 and 60. Two edges 70 and 80 extend between the ends 50 and 60. The fold line 40 is substantially parallel to edges 70 and 80. Fold line 40 may be a roedial fold line as shown in the drawings, substantially midway between the lateral edges 70 and 80, or may be offset from the true centerline in either direction toward either edge 70 or 80. (The offset arrangement is not shown). A second panel of fabric 90 extends at least part way from end 60 toward end 50, and is fastened to panel 20 along end 50 and along at least a portion of each of edges 70 and 80. This forms a pocket 100 having an opening preferably facing toward end 50. Fabric interior panel 90 is also folded in use along a longitudinal fold line 120 which is generally parallel and adjacent to fold line 40. (Fold line 120 of interior panel 90 is also shown in FIGS. 12 and 14 as fold line 230.) Interior panel 90 is preferably made shorter than exterior fabric panel 20. Interior panel 90 is preferably made of a spandex type of material, such as cotton Lycra™ made of fiber available from E. I du Pont de Nemours & Co. Inc. of Wilmington, Del. Other materials similar to Lycra™ are Glospun™, Numa™, Unel™, and Vyrene™. For some purposes, interior panel 90 may alternatively be made of non-stretch material. The ends 50 and 60 are preferably made curved as shown in FIGS. 1, 2, 3, and 4, so that when the sweatband is bent around to a closed loop and the ends 50 and 60 fastened together, a generally V-shaped notch 130 is formed. (Another embodiment having slanted ends is described hereinbelow.) Fasteners 140 and 150, preferably hook-and-loop fasteners such as Velcro™, are attached adjacent to ends 50 and 60 to hold the sweatband in its closed-loop configuration while worn by a user. Either one or both strips of hook-and-loop fastener material may be made long enough to allow considerable adjustment in the diameter of the closed loop, to fit the user.

Figure 3:
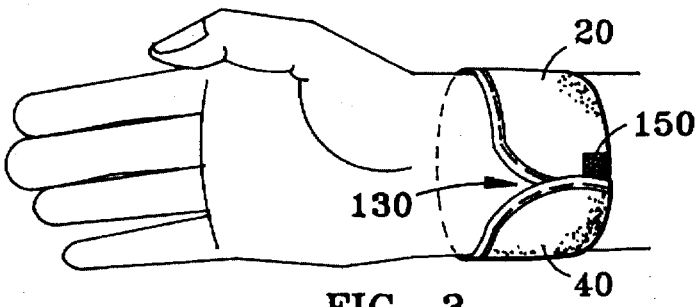
FIG. 3 shows a perspective view of a sweatband in its fastened position on a user's wrist.
Figure 4:
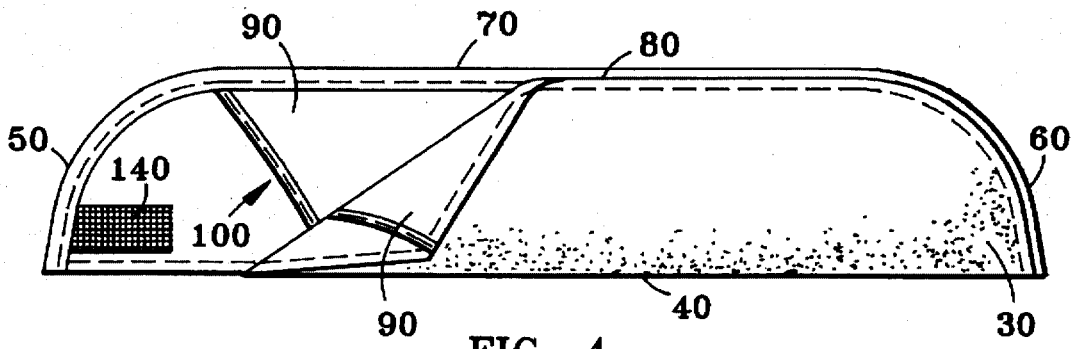
FIG. 4 shows a plan view of one side of the sweatband in its unfastened position.
Figure 5:
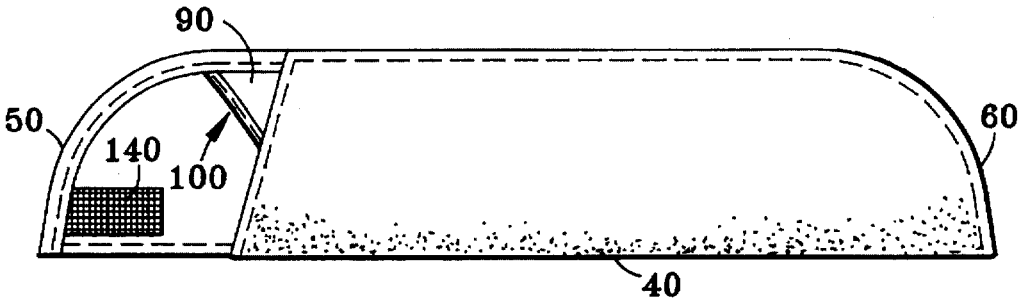
FIG. 5 shows a plan view of one side of the sweatband in its fully folded and unfastened position.
Figure 6:
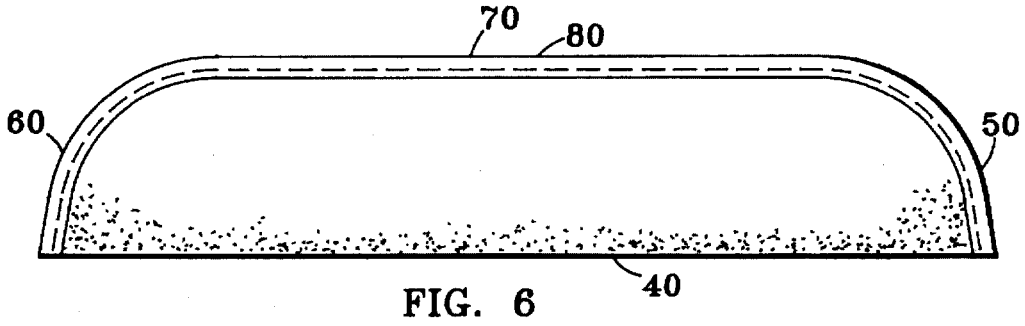
FIG. 6 shows a plan view of another side of the sweatband of FIG. 5.
Figure 7:
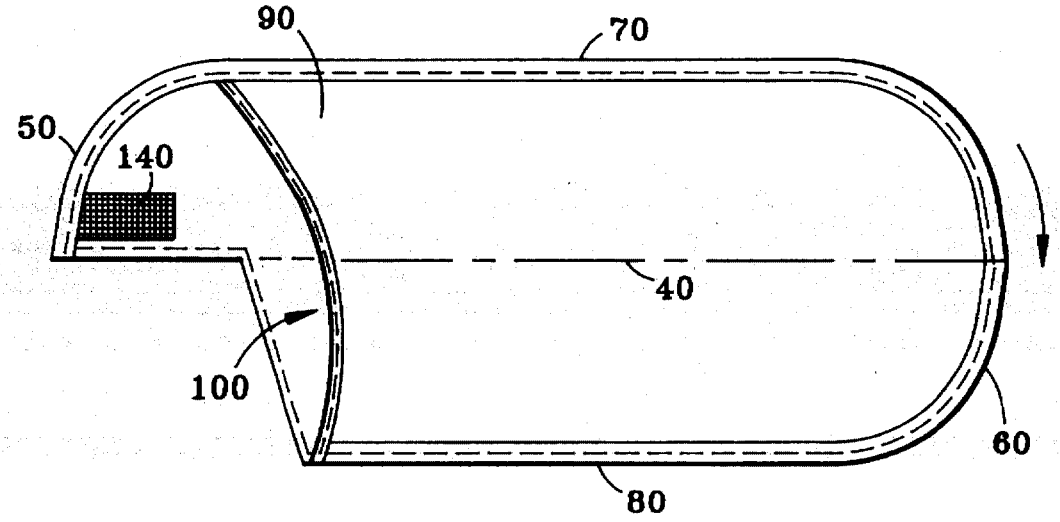
FIG. 7 shows a sweatband, in an unfolded position.

Before forming the closed loop, a user may put small items into pocket 100 through its opening, and fold the sweatband along fold lines 120 and 40. The user may then place the sweatband where it is to be worn with pocket 100 on the inside, and fasten fasteners 140 and 150 to make a closed loop of a desired size to fit. For most users, notch 130 is preferably positioned as shown in FIG. 3, adjacent to the inside of the user's joint, where it provides for less-restricted motion. Other users may find the reverse orientation more comfortable.

Figure 8:
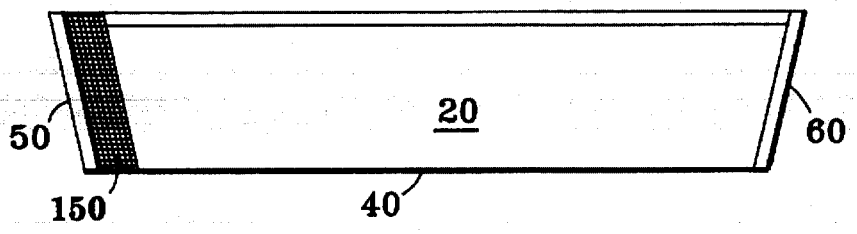
FIG. 8 shows a plan view of another embodiment of a sweatband made in accordance with the invention.
Figure 9:
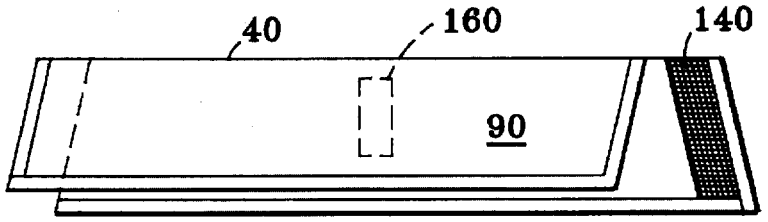
FIG. 9 shows a plan view of another side of the sweatband embodiment of FIG. 8.
Figure 10:
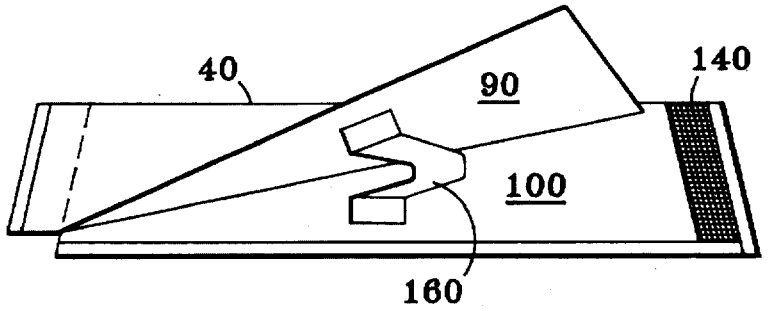
FIG. 10 shows a perspective view of the sweatband embodiment of FIG. 8, in a partially unfolded position.

FIGS. 8, 9, and 10 show various views of another embodiment of the invention. The embodiment of FIGS. 8–10 is somewhat similar to the embodiment of FIGS. 1–7, but forms the pocket in a different manner, and has an elastic strip portion 160. Exterior fabric panel 20 is shown in FIGS. 8–10 with slanted (diagonally trimmed) ends 50 and 60, which come together in a generally V-shaped notch 130 when the sweatband is formed into a closed loop configuration, similar to the embodiment described above. The interior fabric panel 90 is attached to fabric panel 20 along one end 50 and along one longitudinal edge 70. The two ends of elastic strip 160 are attached to the facing sides of panels 20 and 90 so that when pocket 100 is opened, elastic strip 160 extends transversely between the panels. The user's finger or fingers may be placed between the elastic strip 160 and the inside surface of exterior panel 20, to hold the absorbent outer surface of panel 20 against anything to be wiped clean or dry. When pocket 100 is closed, elastic strip 160 folds up. Elastic strip 160 may be attached to the interior portion of the sweatband at a position intermediate between the ends of elastic strip 160, to define two finger loops, for example. If elastic strip 160 is attached to the interior portion of the sweatband at two intermediate positions, three finger loops are defined, and so on.

While the embodiments of FIGS. 1–7 and 11–14 on the one hand are shown with curved ends, and the embodiment of FIGS. 8–10 on the other hand is shown with slanted ends, it will be apparent that either type of end design or both types together may be used in any embodiment. An optional third liner layer of fabric 170 is preferably sewn to outer panel 20, against its inside surface, to serve as a lining of the outer panel 20. Liner layer 170, if present, would be visible at the left end of FIGS. 4, 5, 7 and 11, and at the top end of FIGS. 12–14, adjacent to the opening of pocket 100 in each drawing. Interior fabric panel 90 and liner layer 170 may be made of a decorative fabric. Fastener 140 may be o attached to a liner layer 170 if any.

Figure 13:
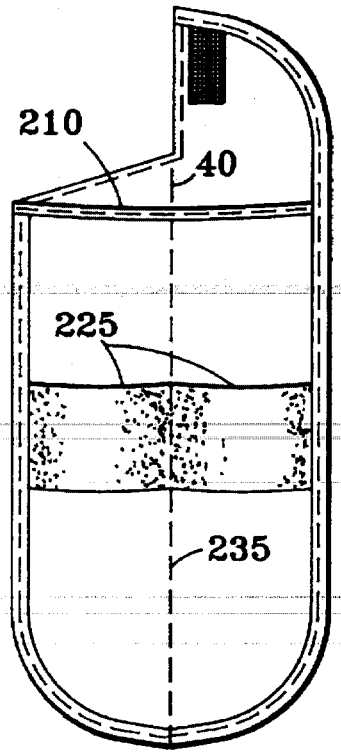
FIG. 13 shows a plan view of a sweatband with alternative pocket and loop configurations, in an unfolded, unfastened position.

FIGS. 12 and 13 show various configurations for the edge 210 or 220 of the opening of pocket 100. In FIGS. 12–14, the edge 210 or 220 may be located anywhere along the interior length, providing pockets of any depth in various embodiments. Pocket 100 may be divided into two or more pockets, e.g. by fastening the interior surfaces together along some portion of fold line 230 of interior panel 90, as shown by stitching 255 in FIG. 13. FIG. 13 also shows optional finger loops 225, which may be formed of elastic strip similar to elastic strip 160.

Figure 11:
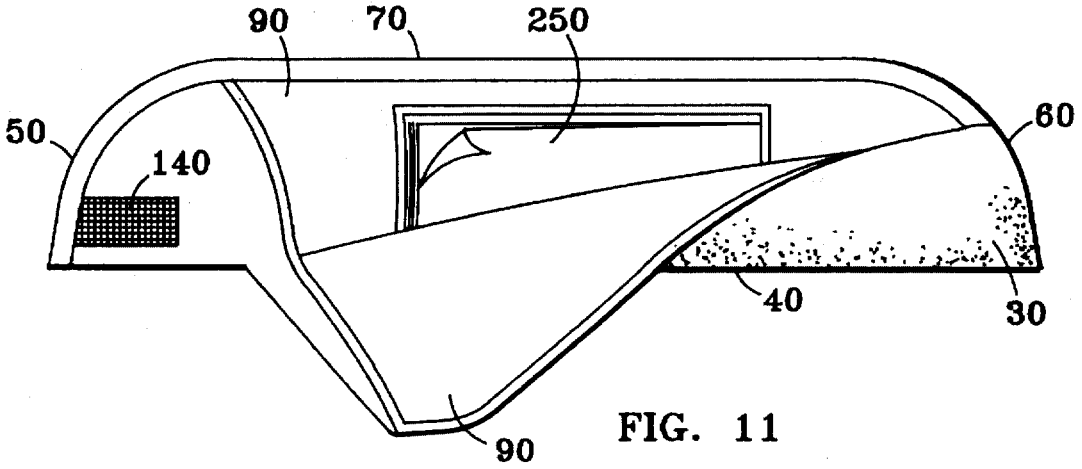
FIG. 11 shows a perspective view of another sweatband embodiment in a partially unfolded position.

Other embodiments of the invention may be made by various modifications to the embodiments described hereinabove. Modifications to the inner panel can include attaching an additional piece of material to form a closed pocket. This may be a flap that extends over the opening of pocket 100, or may be a separate pocket. The inner panel may be made of an abrasive material for cleaning uses, or separate pieces of abrasive material 240 may be attached to the inner panel as shown in FIG. 14. The inner panel may be made of any reasonably flexible material, such as terry cloth, cotton jersey, spandex materials (fabrics containing synthetic fibers having long-chain polymers of at least 85% segmented polyurethanes), biconstituent materials such as the nylon-spandex material Monvelle™ available from Monsanto Textiles, Co., etc. The interior panel may be made of a non-stretch fabric. The interior panel may alternatively be made in such a way that one or more layers are removable. For example, as shown in FIG. 11, a stack 250 of removable and disposable layers such as tissue paper or HandiWipe™ may be attached to interior panel 90. A user can then peel off, use, and discard each layer. An embodiment using this stack of removable layers may include or exclude the pocket 100. In yet another alternative embodiment, the interior panel may be made of a material or a packet of material, such as a polyacrylamide, which when suitably soaked in water and chilled or heated may provide a source of cold or heat for treating injuries. For some embodiments the exterior panel may be made of a non-absorbent material, and used as a decorative layer, camouflage for hunters, etc.

The sweatband of this invention has many varied uses. It may be used while engaged in any type of labor and in sports and exercising, to blot or wipe away perspiration. It may be used as a wristband or ankle-band or (when unfolded) as a mitt. When used as a wristband or ankle-band, the V-shaped notch of the preferred embodiment may be positioned to allow free movement of the joint. For use as a mitt, the band is unfolded and the fingers inserted into the pocket or into one or more loops of elastic strip. Valuables such as coins, paper currency, or keys may be secured in the pocket. Various types of surfaces may be cleaned with the invention, using either the inner or outer layers. Warm or cold packs, such as pouches containing a liquid or gel, may be held in the pocket to keep the warmth or cold secure on a limb, wrist or other joint. Weights may be inserted in the pocket to increase effort expended in exercise. The inner surfaces, including the inner surface of the pocket can serve as a cleaning tool, to clean golf bails, golf club heads, tennis racket hand grips, or handballs, for example.

From the foregoing description, one skilled in the art can easily ascertain the essential characteristics of this invention, and without departing from the spirit and scope thereof, can make various changes, alterations, substitutions, and modifications of those embodiments that have been described in the preceding description, to adapt the invention to various usages and conditions. Other embodiments of the invention will be apparent to those skilled in the art from a consideration of this specification or from practice of the invention disclosed herein. For example, the invention can be made in sizes to fit a user's waist, or can be made to be worn diagonally from shoulder to hip as a sash, or can be made with a series of fasteners spaced to provide a variety of sizes when fastened. It is intended that the specification and examples be considered as exemplary only, with the true scope and spirit of the invention being defined by the following claims.

Having described my invention, I claim:

1. A sweatband to be worn by a user, comprising:

(a) an elongated first panel of fabric, said first panel having first and second sides, at least said first side being moisture-absorbent, said first panel having first and second ends, and having first and second edges extending between said first and second ends, said first panel being adapted to be folded along a first fold line extending between said first and second ends;

(b) a second panel of fabric fastened to said first panel along at least said first end and along at least a portion of said first and second edges of said first panel to form a pocket, said pocket opening toward said second end; and (c) means for temporarily fastening said first end of said first panel to said second end of said first panel to form a closed loop having an interior surface, said interior surface including said pocket; and said closed loop being adapted to fit the user.

2. A sweatband as recited in claim 1, wherein each of said first and second ends has a curvilinear shape adapted to form a V-shaped notch when said first and second ends are temporarily fastened one to the other.

3. A sweatband as recited in claim 1, wherein each of said first and second ends has a diagonally cut shape adapted to form a V-shaped notch when said first and second ends are temporarily fastened one to the other.

4. A sweatband as recited in claim 1, wherein said second panel is shorter than said first panel.

5. A sweatband as recited in claim 1, wherein said second panel is adapted to be folded along a second fold line.

6. A sweatband as recited in claim 1, wherein said means for temporarily fastening comprises a hook and loop fastener.

7. A sweatband as recited in claim 1, further comprising a third layer of fabric characterized by being substantially non-moisture-absorbent, fastened to at least said first panel to form a liner.

8. A sweatband as recited in claim 1, further comprising one or more loops of flexible material, said loops being attached to said second panel of fabric at positions suitable to provide space for a user's fingers within said loops.

9. A sweatband as recited in claim 1, further comprising a quantity of flexible abrasive material fastened to said second panel of fabric, for cleaning articles when said sweatband is not being worn by the user.

10. A sweatband as recited in claim 1, further comprising a multiplicity of individually removable layers of tissue-like material disposed in a stacked configuration attached to said second panel of fabric, for cleaning articles when said sweatband is not being worn by the user.

11. A sweatband as recited in claim 7, wherein said third layer of fabric forms a liner inside said pocket.

12. A sweatband to be worn by a user, comprising:

(a) an elongated first panel of fabric, said first panel having first and second sides, at least said first side being moisture-absorbent, said first panel having first and second ends, and having first and second edges extending between said first and second ends, said first panel being adapted to be folded along a first fold line extending between said first and second ends, said first and second ends having a curvilinear shape;

(b) a second panel of fabric shorter than said first panel fastened to said first panel along at least said first end and along at least a portion of said first and second edges of said first panel to form a pocket, said pocket opening toward said second-end; and (c) hook-and-loop fastener means adapted for temporarily fastening said first end of said first panel to said second end of said first panel to form a closed loop having a notch formed by said curvilinear shapes, and having an interior surface, said interior surface including said pocket; said closed loop being adapted to fit the user.

13. A sweatband to be worn by a user, comprising:

(a) an elongated first panel of fabric, said first panel having first and second sides, at least said first side being moisture-absorbent, said first panel having first and second ends, and having first and second edges extending between said first and second ends, said first panel being adapted to be folded along a first fold line extending between said first and second ends;

(b) a second panel of fabric shorter then said first panel fastened to said first panel along at least said first end and along at least a portion of said first edge of said first panel to form a pocket, said pocket opening toward said second end;

(c) a strip formed of elastic material having elastic strip ends, fastened to said first panel along said elastic strip ends to provide an opening for insertion of at least one finger; and (d) means for temporarily fastening said first end of said first panel to said second end of said first panel to form a closed loop adapted to fit the user, wherein each of said first and second ends has a curvilinear shape adapted to form a V-shaped notch when said first and second ends are temporarily fastened one to the other.

14. A sweatband to be worn by a user, comprising:

(a) an elongated first panel of fabric, said first panel having first and second sides, at least said first side being moisture-absorbent, said first panel having first and second ends, and having first and second edges extending between said first and second ends, said first panel being adapted to be folded along a first fold line extending between said first and second ends;

(b) a second panel of fabric shorter then said first panel fastened to said first panel along at least said first end and along at least a portion of said first edge of said first panel to form a pocket, said pocket opening toward said second end;

(c) a strip formed of elastic material having elastic strip ends, fastened to said first panel along said elastic strip ends to provide an opening for insertion of at least one finger; and (d) means for temporarily fastening said first end of said first panel to said second end of said first panel to form a closed loop adapted to fit the user, wherein each of said first and second ends has a diagonally cut shape adapted to form a V-shaped notch when said first and second ends are temporarily fastened one to the other.

15. A sweatband as recited in claim 13 or 14, further comprising a third layer of fabric characterized by being substantially non-moisture-absorbent, fastened to at least said first panel to form a liner.

16. A sweatband as recited in claim 13 or 14, further comprising one or more loops of flexible material, said loops being attached to said second panel of fabric at positions suitable to provide space for a user's finger within said loops.

17. A sweatband as recited in claim 13 or 14, further comprising a quantity of flexible abrasive material fastened to said second panel of fabric, for cleaning articles when said sweatband is not being worn by the user.

18. A sweatband as recited in claim 13 or 14, further comprising multiplicity of individually removable layers of tissue-like material disposed in a stacked configuration attached to said second panel of fabric, for cleaning articles when said sweatband is not being worn by the user.

* * * * *